United States Patent [19]

Williams et al.

[11] Patent Number: 4,784,393

[45] Date of Patent: Nov. 15, 1988

[54] GOLF SWING TRAINING DEVICE

[76] Inventors: Robert E. Williams, 619 Anderson, Memphis, Tenn. 38104; Silas C. Byers, 3441 Village Grove Rd. P1.W.#7, Memphis, Tenn. 38115

[21] Appl. No.: 54,222

[22] Filed: May 26, 1987

[51] Int. Cl.[4] ..... A63B 69/36

[52] U.S. Cl. ..... 273/187 R

[58] Field of Search ..... 273/187 R, 187 B, 195 B, 273/183 A

[56] References Cited

U.S. PATENT DOCUMENTS

| | | | |
|---|---|---|---|
| 1,517,555 | 12/1924 | Graham | 273/187 R |
| 2,150,580 | 3/1939 | Crowley | 273/187 R |
| 2,457,351 | 12/1948 | Crowley | 273/187 R |
| 3,229,981 | 1/1966 | Taber | 273/187 R |
| 3,253,830 | 5/1966 | Laskin | 273/187 R |
| 3,343,268 | 9/1967 | Schennum | 273/187 R |
| 3,638,950 | 2/1972 | Hyotlaine | 273/187 R |
| 3,658,344 | 4/1972 | Kimble | 273/187 R |
| 3,868,116 | 2/1975 | Ford et al. | 273/187 R |
| 4,257,608 | 3/1981 | Funk | 273/187 R |

FOREIGN PATENT DOCUMENTS

| | | | |
|---|---|---|---|
| 16930 | of 1911 | United Kingdom | 273/187 R |
| 1261524 | 1/1972 | United Kingdom | 273/187 R |

*Primary Examiner*—George J. Marlo

*Attorney, Agent, or Firm*—Walker & McKenzie

[57] ABSTRACT

A golf swing training device including a first body member attached at a perpendicular angle to a second body member with structure for extending through both body members to anchor the device to the ground with one end of the first body member abutting a golf ball. A hinge allows the front end of the first body member to be pivoted back onto the rear end of the first body member away from the golf ball. An elongated right foot positioning structure is pivotally attached adjacent the right end of the second body member with the longitudinal axis of the right foot positioning structure at an angle to the longitudinal axis of the second body member. An elongated left foot positioning structure is pivotally attached adjacent the left end of the second body member with the longitudinal axis of the left foot positioning structure at an angle to the longitudinal axis of the second body member. The right and left foot positioning structures extend outward from the second body member on the side thereof opposite the front end of the first body member.

6 Claims, 6 Drawing Sheets

GOLF SWING TRAINING DEVICE

BACKGROUND OF THE INVENTION

1. Field of the Invention

The present invention relates, in general, to a device for use as a training aid to properly position a golfer's stance relative to a golf ball and the target line between the golf ball and the target.

2. Description of the Related Art

A golfer's stance relative to a golf ball and a target line between the golf ball and a target is critical for optimum accuracy, etc. The proper position of a golfer's stance varies depending on the golfer's physical characteristics (height, strength, etc.), the golf club being used, etc. The normal method of learning to assume the proper stance now typically consists of verbal or written instructions specifying the proper stance and practice based on estimates relative to the distance from the golf ball and the proper angles relative to the target line, etc. Funk, U.S. Pat. No. 4,257,608 discloses a positioning device for a golfer which includes an unslotted lateral scale strip having an upper surface at least a six inch length of which is free of scale markings to provide a space for inscribing notes, two correspondingly narrow foot-aligning strips with one of the foot-aligning strips pivotally secured near one end of the lateral scale strip and with the other foot-aligning strip slidably and pivotally secured to the lateral scale strip, and an unslotted perpendicular scale strip mounted for non-pivotal sliding along the lateral scale strip as well as for non-pivotal sliding and removal perpendicularly with respect to the lateral scale strip; to use the device the golfer first positions the foot-aligning strips and perpendicular scale strip according to the type of golf club to be used, etc., then places the device on the ground with the golf ball located adjacent the outer end of the perpendicular scale strip and with the lateral scale strip pointed toward the target, and aligns his feet with the foot-aligning strips on the opposite side of the lateral scale strip from the foot-aligning strips.

SUMMARY OF THE INVENTION

The present invention is directed toward providing a unique golf swing training device for use as a training aid to properly position a golfer's stance relative to a golf ball and a target line between the golf ball and a target. The concept of the present invention is to provide guide means for the proper positioning of a golfer's feet relative to a golf ball and a target line between the golf ball and a target.

The golf swing training device of the present invention comprises, in general, a body member having a front end for being placed adjacent a golf ball; a right foot positioning means attached relative to the body member a specific distance from the front end of the body member with the longitudinal axis of the right foot positioning means being at a specific angle to the target line between a golf ball and a target for providing a guide for the proper positioning of the golfer's right foot relative to the golf ball and the target line, the right foot positioning means having a longitudinal side edge along which the golfer's right foot is positioned; and a left foot positioning means attached relative to the body member a specific distance from the front end of the body member with the longitudinal axis of the left foot positioning means being at a specific angle to the target line for providing a guide for the proper positioning of the golfer's left foot relative to the golf ball and the target line, the left foot positioning means having a longitudinal side edge along which the golfer's left foot is positioned.

DESCRIPTION OF THE PREFERRED EMBODIMENT

Figures 1, 2:
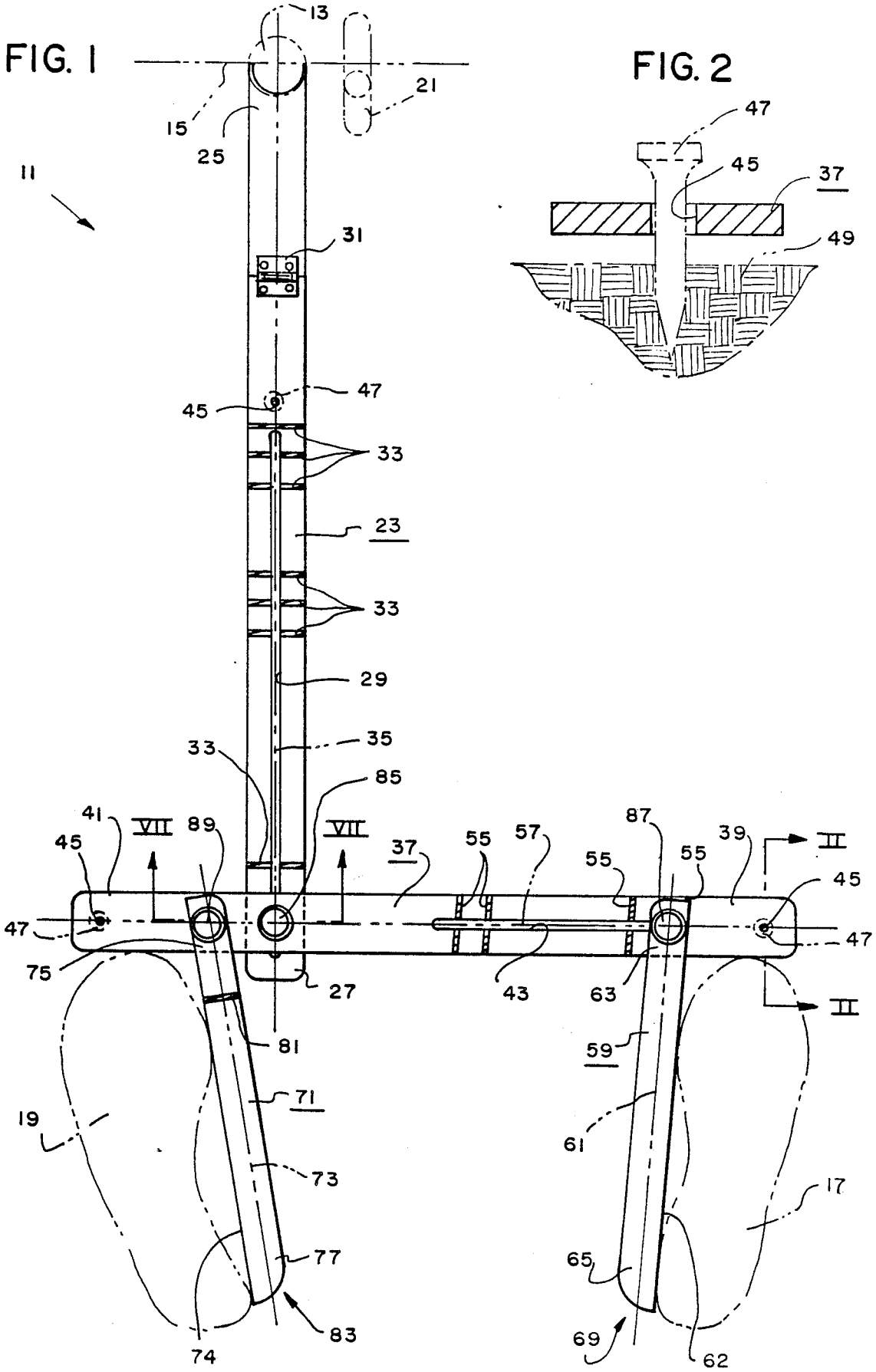
FIG. 1 is a top plan view of the golf swing training device of the present invention with a golf ball, a golf club and the outline of a golfer's feet shown in broken lines.
FIG. 2 is an enlarged sectional view of a portion of the device substantially as taken on line II—II of FIG. 1.

The golf swing training device 11 of the present invention is for use as a training aid to properly position a golfer's stance relative to a golf ball 13 and a target line 15 between the golf ball 13 and a target (not shown). The device 11 is preferably adjustable to provide a positioning guide for the proper positioning of the golfer's right and left feet 17, 19 depending on the specific golf club 21 used, the golfer's physical characteristics, etc.

Figure 8:
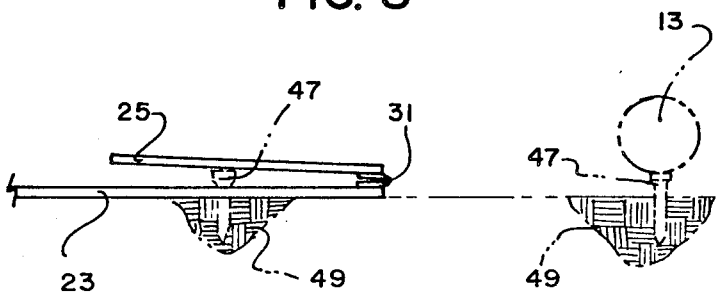
FIG. 8 is a side elevational view of the front end of the first body member of the device of the present invention in a moved position.

The preferred embodiment of the device 11 includes an elongated first body member 23 having a front end 25 for being placed in an abutting or substantially abutting relationship with the golf ball 13 and having a rear end 27. The front end 25 of the first body member 23 may have a concave curve therein for encircling a portion of the golf ball 13. The first body member 23 preferably has an elongated slot 29 therein extending from a point adjacent the rear end 27 thereof toward the front end 25 thereof for reasons which will hereinafter be explained. The first body 23 may be constructed of a substantially rigid length of wood, plastic, or the like. The front end 25 of the first body member 23 is preferably movable relative to the rear end 27 thereof. Thus, a portion of the front end 25 of the first body member 23 may be constructed separate from the remainder thereof and pivotally connected thereto by a typical hinge means 31 to allow the front end 25 to be selectively pivoted back on the remainder of the first body member 23 as shown in FIG. 8 whereby the golf ball 13 is unhindered by the device 11. Various indicia markings 33 are preferably provided on the first body member 23 for reasons which will hereinafter be explained. When using the device 11, the first body member 23 is positioned with the front end 25 thereof in the extended position in an abutting relationship with the golf ball 13 and with the longitudinal axis 35 of the first body member 23 perpendicular to the target line 15. The slot 29 preferably extends parallel to and along the longitudinal axis 35. The indicia markings 33 are preferably located at precise right angles to the longitudinal axis 35 for reasons which will hereinafter be explained.

The preferred embodiment of the device 11 includes an elongated second body member 37 having a right end 39 and a left end 41. The seocnd body member 37 has an elongated slot 43 therein extending from a point substantially adjacent the right end 39 thereof toward the left end 41 thereof for reasons which will hereinafter be explained. Apertures 45 may be provided through the second body member 37 directly adjacent the opposite ends 39, 41 thereof and through the first body member 37 at a location between the rear end 27 and the hinge means 31 thereof for allowing a typical golf tee 47 or the like to extend therethrough and into the ground 49 to thereby anchor the device 11 to the ground 49. The second body member 37 preferably has an additional pair of apertures 51, 53 therethrough for reasons which will hereinafter be explained. Indicia markings 55 are provided on the second body member 37 for reasons which will hereinafter be explained. The second body member 37 is preferably attached to the first body member 23 with the longitudinal axis 57 of the second body member 37 perpendicular to the longitudinal axis 35 of the first body member 23 whereby the longitudinal axis 57 of the second body member 37 will be parallel to the target line 15. The indicia markings 55 are preferably located at precise angles relative to the longitudinal axis 57 of the second body member 37 and, thus, at precise angles relative to the longitudinal axis 35 of the first body member 23 for reasons which will hereinafter be explained.

The device 11 preferably includes an elongated right foot positioning means 59 attached to the second body member 37 substantially adjacent the right end 39 thereof with the longitudinal axis 61 of the right foot positioning means 59 located at a specific angle relative to the longitudinal axis 57 of the second body member 37 and, thus, the longitudinal axis 35 of the first body member 23 for providing a guide for the proper positioning of the golfer's right foot 17 relative to the golf ball 13 and the target line 15 in a manner which will hereinafter be described. The right foot positioning means 59 has a longitudinal side edge 62 along which the golfer's right foot is positioned (see FIG. 1). The right foot positioning means 59 has a first end 63 and a second end 65 with an aperture 67 therethrough substantially adjacent the first end 63 for reasons which will hereinafter be explained. The left side of the second end 65 of the right foot positioning means 59 is preferably rounded as indicated by the arrow 69 for reasons which will hereinafter be explained.

The device 11 preferably includes an elongated left foot positioning means 71 attached to the second body member 37 substantially adjacent the left end 41 thereof with the longitudinal axis 73 of the left foot positioning means located at a specific angle relative to the longitudinal axis 57 of the second body member 37 and, thus, to the longitudinal axis 35 of the first body member 23 for providing a guide for the proper positioning of the golfer's left foot 19 relative to the golf ball 13 and the target line 15 in a manner which will hereinafter be described. The left foot positioning means 71 has a longitudinal side edge 74 along which the golfer's left foot is positioned (see FIG. 1). The left foot positioning means 71 has a first end 75 and a second end 77 with an aperture 79 therethrough substantially adjacent the first end 75 thereof for reasons which will hereinafter be explained. Indicia marking 81 is preferably provided on the left foot positioning means 71 at a specific point between the first and second ends 75, 77 thereof for reasons which will hereinafter be explained. The right side of the second end 77 of the left foot positioning means 71 is preferably rounded as indicated by the arrow 83 for reasons which will hereinafter be explained.

Figures 3, 4:
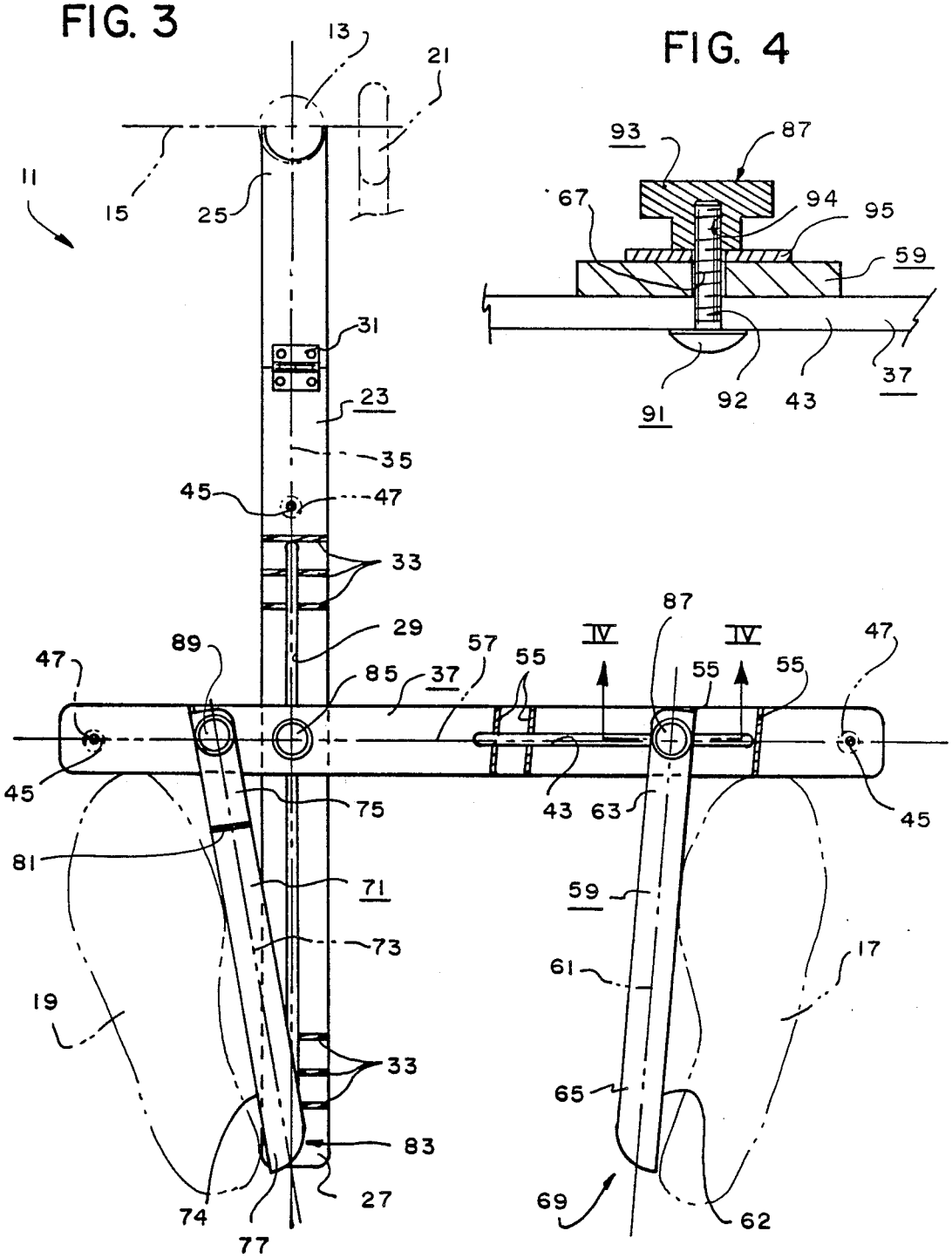
FIG. 3 is a top plan view of the device similar to FIG. 1 but with portions of the device in a moved position.
FIG. 4 is an enlarged sectional view of a portion of the device substantially as taken on line IV—IV of FIG. 3.
Figure 5:
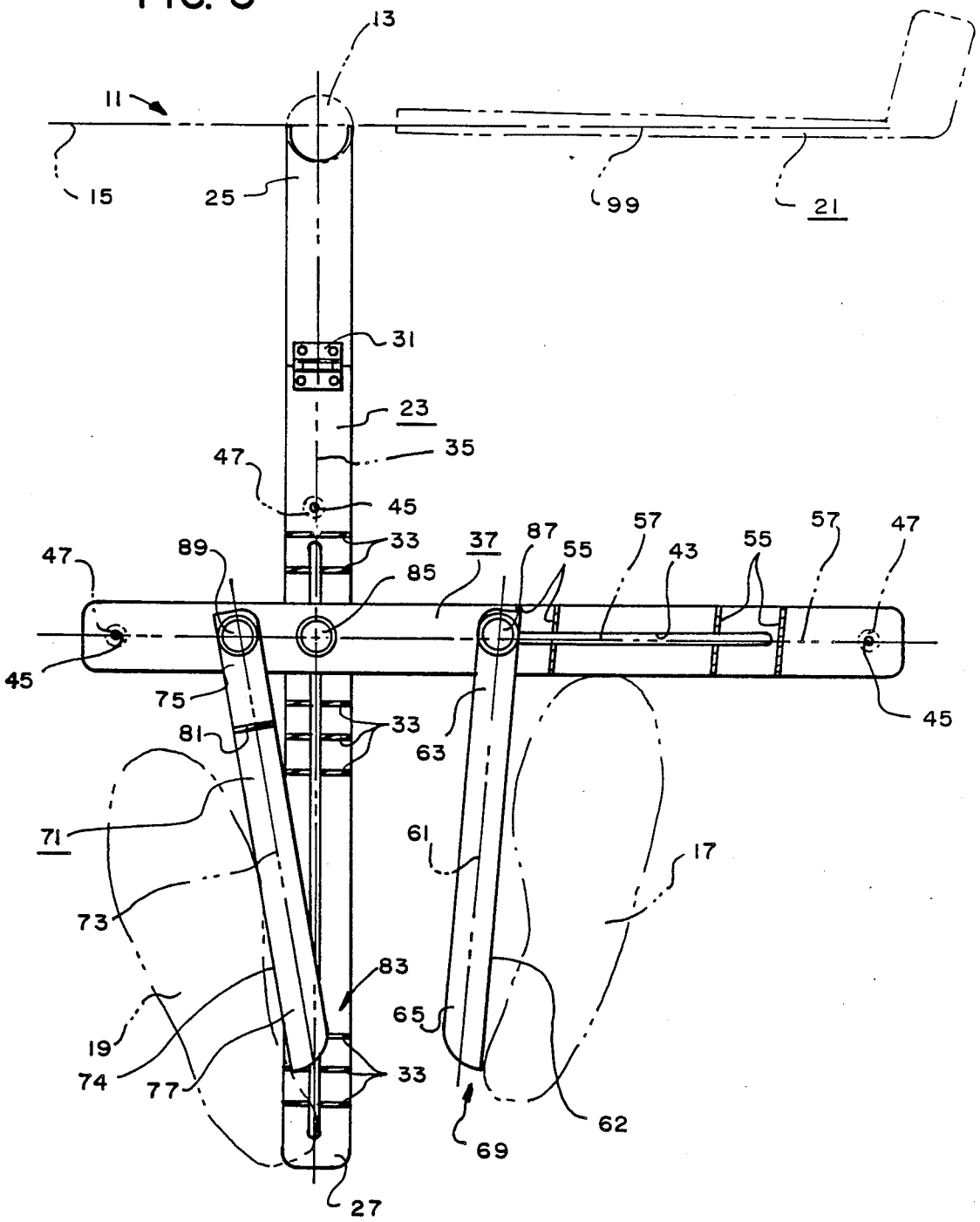
FIG. 5 is a top plan view of the device similar to FIGS. 1 and 3 but with portions of the device in a moved position.
Figure 6:
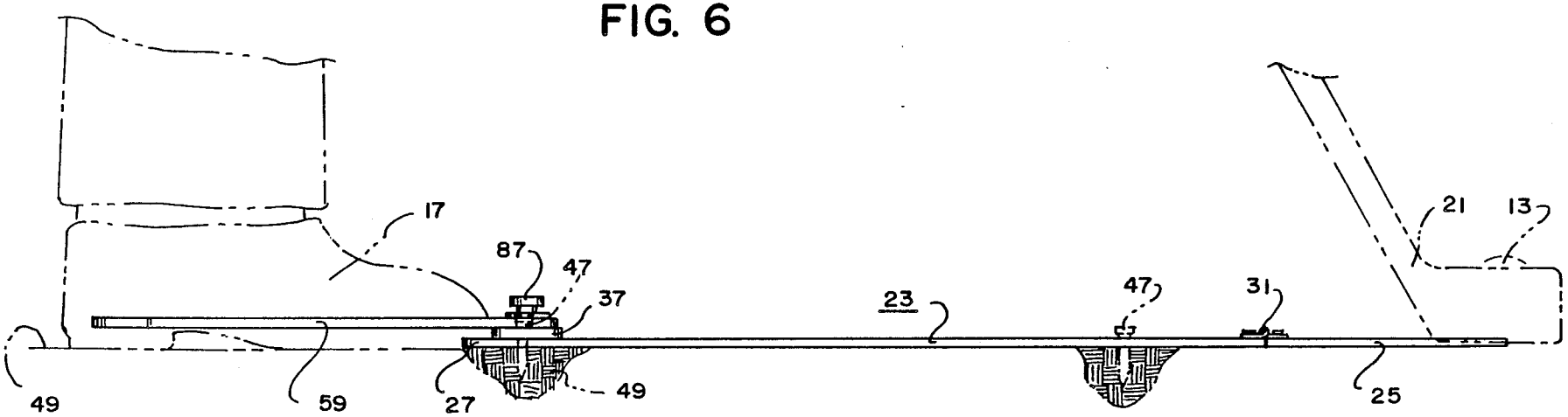
FIG. 6 is a side elevational view of FIG. 1.
Figure 7:
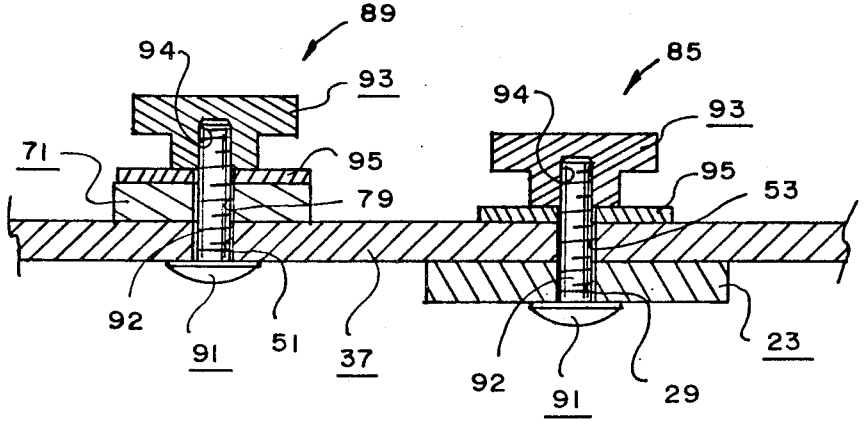
FIG. 7 is an enlarged sectional view of a portion of the device substantially as taken on lines VII—VII of FIG. 1.

The device 11 preferably includes a first attachment means 85 for movably attaching the first body member 23 and the second body member 37 to one another, a second attachment means 87 for movably attaching the second body member 37 and the right foot positioning means 59 to one another, and a third attachment means 89 for movably attaching the second body member 37 and the left foot positioning means 71 to one another. Each attachment means 85, 87, 89 may be identical to one another and preferably includes a bolt member 91 having a threaded shaft 92, a knob member 93 having a threaded aperture 94 for coactingly receiving the shaft 92, and a washer member 95. The shaft 92 of the bolt member 91 of the first attachment member 85 extends through the slot 29 in the first body member 23 and through the aperture 53 in the second body member 37 (see FIG. 7) whereby the first attachment means 85 both pivotally and slidably couples the first and second body members 23, 37 to one another. The shaft 92 of the bolt member 91 of the second attachment means 87 extends through the slot 43 in the second body member 37 and the aperture 67 in the right foot positioning means 59 (see FIG. 4) whereby the second attachment means 87 both pivotally and slidably couples the second body member 37 and right foot positioning means 59 to one another. The shaft 92 of the bolt member 91 of the third attachment means 89 extends through the apertures 51 in the second body member 37 and the aperture 79 in the left foot positioning means 71 (see FIG. 7) whereby the third attachment means 89 pivotally couples the second body member 37 and the left foot positioning means 71 to one another.

Figure 9:
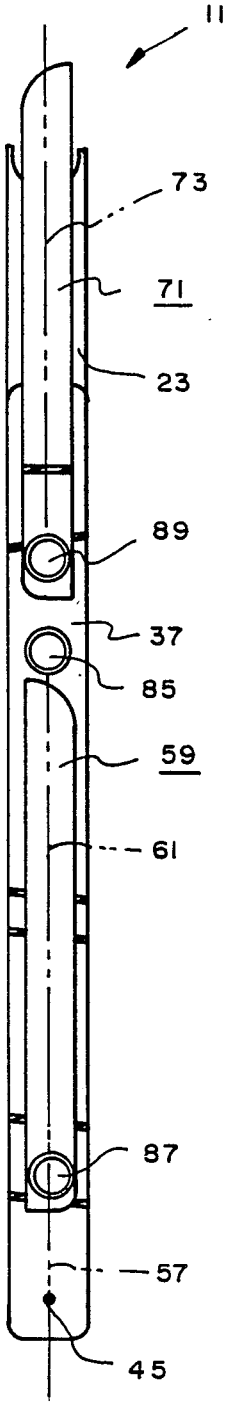
FIG. 9 is a top elevational view of the device shown in a collapsed position.
Figure 10:
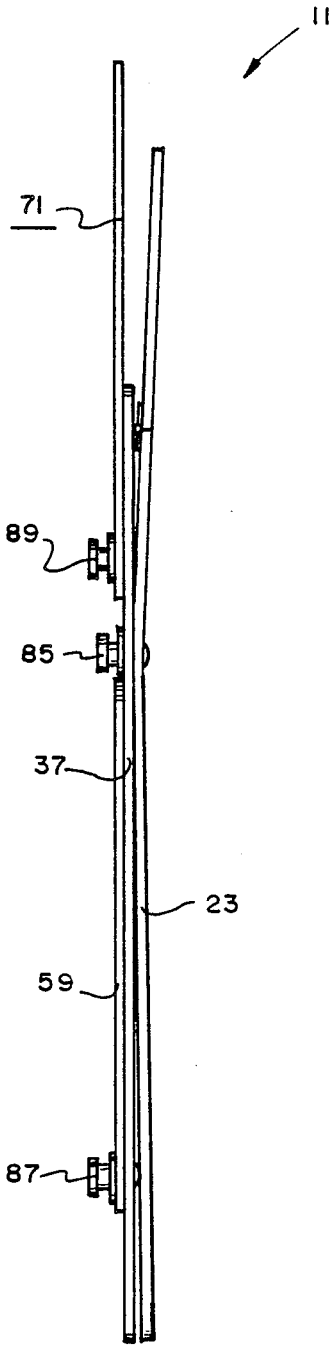
FIG. 10 is a side elevational view of FIG. 9.

The attachment means 85, 87, 89 thus allow the device 11 to be moved between a folded or collapsed position (see FIGS. 9 and 10) in which the device 11 can be easily stored within a typical golf club bag or the like and an extended or in-use position (see, in general, FIGS. 1, 3, 5 and 6). When in the folded position, the longitudinal axes 57, 61, 73 of the second body member 37, right foot positioning means 59 and left foot positioning means 71, respectively, are positioned substantially in-line with the longitudinal axis 35 of the first body member 23.

To move the device 11 from the folded position to the in-use position, the attachment means 85, 87, 89 are loosened and the second body member 37 pivoted until it aligns with an appropriate indicia marking 33 on the first body member 23 whereby the longitudinal axis 57 of the second body member 37 will be positioned at a precise right angle to the longitudinal axis 35 of the first body member 23. The first attachment means 85 is then tightened to secure the first and second body members 23, 37 relative to one another. The right foot positioning means 59 is pivoted until it aligns with an appropriate indicia marking 55 on the second body member 57 whereby the longitudinal axis 61 of the right foot positioning means 59 will be positioned at a specific angle relative to the longitudinal axis 57 of the second body member 37 and, thus, the longitudinal axis 35 of the first body member 23. The attachment means 87 is then tightened to secure the second body member 37 and right foot positioning means 59 relative to one another. The left foot positioning means 71 is likewise pivoted until it aligns with the appropriate indicia marking 55 on the second body member 37 whereby the longitudinal axis 73 of the left foot positioning means 71 will be positioned at a precise angle to the longitudinal axis 57 of the second body member 37 and, thus, the longitudinal axis 35 of the first body member 23. The attachment means 89 is then tightened so as to secure the second body member 37 and the left foot positioning means 71 relative to one another.

Figure 11:
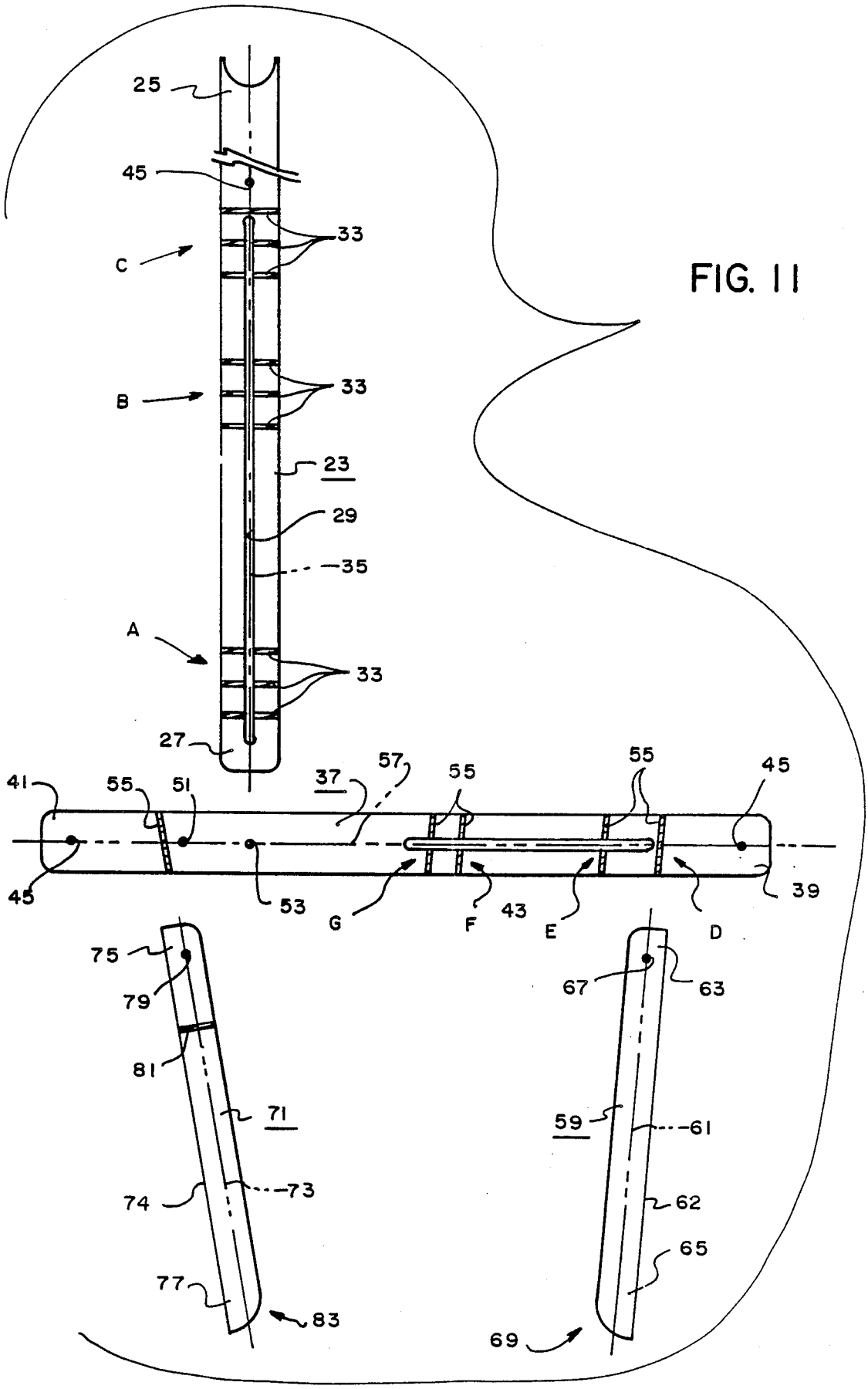
FIG. 11 is an exploded top plan view of certain components of the present invention.

To utilize the device 11 as a training aid to properly position the golfer's stance relative to the golf ball 13 and the target line 15, the front end 25 of the first body member 23 is positioned directly adjacent the golf ball 13 in an abutting or substantially abutting position with the golf ball 13 as clearly shown in FIGS. 1, 3, 5 and 6 with the longitudinal axis 35 of the first body member 23 located perpendicular to the target line 15. One manner of so-positioning the longitudinal axis 35 of the first body member 23 perpendicular to the target line 15 is to determine the target line 15 in the normal manner by manually "sighting" the target line 15 from a point behind the golf ball 13 and then laying the golf club 21 on the ground adjacent the golf ball 13 with the longitudinal axis 99 of the golf club aligned with the "slighted" target line 15 (see FIG. 5). Next, since the longitudinal axis 57 of the second body member 37 is perpendicular to the longitudinal axis 35 of the first body member 23, the golfer can merely align the longitudinal axis 57 of the second body member 37 with the longitudinal axis of the golf club by eye to thereby properly position the device 11 relative to the target line 15. With the device 11 properly positioned relative to the golf ball 13 and target line 15 and properly adjusted for the golf club to be used and for the physical characteristics of the golfer, the golfer merely positions his right and left feet 17, 19 adjacent the appropriate positioning means 59, 71 with the front of his right foot 17 positioned adjacent the bottom edge of the second body member 37 and with the front of his left foot 19 positioned either adjacent the bottom edge of the second body member 37 or in line with the indicia marking 81 of the left foot positioning means 71 and pivots the front end 25 of the first body member 23 rearwardly to the position shown in FIG. 8 so that the device 11 does not hinder the golf ball 13 or golf club 21 when the golfer hits the golf ball 13 with the golf club 21. While the precise desired position of the golfer's feet will vary depending on many factors well known to those skilled in the art, the device 11 is preferably constructed so as to be adjustable for any such factor. Thus, the indicia markings 33 of the first body member 23 preferably includes at least a rear set A of three indicia markings 33 (see FIG. 11) for use when the golf club 21 to be used is a driver, an intermediate set B of three indicia markings 33 (see FIG. 11) for use when the golf club 21 to be used is a five iron, and a front set C of three indicia markings 33 (see FIG. 11) for use when the golf club 21 to be used is a nine iron or wedge. The rear indicia marking 33 of each set A, B, C is for use when the golfer is short in height. The intermediate indicia marking 33 of each set A, B, C is for use when the golfer is average in height. The front indicia marking 33 of each set A, B, C is for use when the golfer is tall in height. The indicia marking 55 of the second body member 37 preferably includes at least a first indicia mark D (see FIG. 11) for use when the golf club 21 to be used is a driver, a second indicia mark E (see FIG. 11) for use when the golf club 21 to be used is a five iron, a third indicia mark F (see FIG. 11) for use when the golf club 21 to be used is a nine iron, and a fourth indicia mark G (see FIG. 11) for use when the golf club 21 to be used is a wedge. The indicia marking 81 of the left foot positioning means 71 is for use when the golf club 21 to be used is a wedge. The rounded end portions of the right and left foot positioning means 51, 71 as indicated by the arrows 69, 83 respectively serve as aids to lead the golfer to align his feet with the opposite side of the respective positioning means 51, 71 as will now be apparent to those skilled in the art.

Although the present invention has been described and illustrated with respect to a preferred embodiment thereof and a preferred use therefor, it is not to be so limited since changes and modifications may be made therein which are within the full intended scope of the invention.

I claim:

1. A golf swing training device for use as a training aid to properly position a golfer's stance relative to a golf ball and a target line between the golf ball and a target, said device comprising:

(a) an elongated first body member having a front end for being placed in an abutting relationship with the golf ball with the longitudinal axis of said first body member perpendicular to said target line and having a rear end:

(b) an elongated second body member having a right end and a left end, said second body member being attached to said first body member with the longitudinal axis of said second body member perpendicular to the longitudinal axis of said first body member;

(c) means for extending through said right and left ends of said second body member and said rear end of said first body member and into the ground to anchor said device to the ground;

(d) hinge means for pivotally connecting said front and rear ends of said first body member to one another and for allowing said front end of said first body member to be pivoted back onto the rear end of said first body member after said device has been anchored to the ground with said front end of said first body member abutting the golf ball and for allowing the golf ball to be unhindered by said device;

(e) an elongated right foot positioning means pivotally attached adjacent said right end of said second body member with the longitudinal axis of said right foot positioning means at an angle to the longitudinal axis of said second body member for providing a guide for the proper positioning of the golfer's right foot relative to the golf ball and the target line, said right foot positioning means having a longitudinal side edge along which the golfer's right foot is positioned; and (f) an elongated left foot positioning means pivotally attached adjacent said left end of said second body member with the longitudinal axis of said left foot positioning means at an angle to the longitudinal axis of said second body member for providing a guide for the proper positioning of the golfer's left foot relative to the golf ball and the target line, said left foot positioning means having a longitudinal side edge along which the golfer's left foot is positioned, said right and left foot positioning means extending outward from said second body member on the side thereof opposite said front end of said first body member.

2. The device of claim 1 in which said second body member is movable along the length of said first body member and in which said right foot positioning means is movable along the length of said second body member for allowing said device to be adjusted according to the specific golf club to be used and the physical characteristics of the golfer.

3. The device of claim 2 in which said first body member has a plurality of indicia markings thereon for indicating various preferred locations of said second body member on said first body member depending on the golf club to be used and the physical characteristics of the golfer.

4. The device of claim 3 in which said second body member has a plurality of indicia markings thereon for indicating various preferred locations of said right foot positioning means on said second body member depending on the golf club to be used.

5. The device of claim 4 in which said left foot positioning means has indicia markings thereon for indicating the preferred location of the golfer's left foot depending on the golf club to be used.

6. The device of claim 5 in which said second body member and said right and left foot positioning means can be moved to a folded position with the longitudinal axes thereof in-line with the longitudinal axis of said first body member.

* * * * *